US009466232B2

(12) United States Patent
Woollett et al.

(10) Patent No.: US 9,466,232 B2
(45) Date of Patent: Oct. 11, 2016

(54) METHOD AND APPARATUS FOR DEPLOYING AND SUPPORTING A FLEXIBLE OBJECT

(71) Applicant: Nexus Developments Ltd., Grenada North, Wellington (NZ)

(72) Inventors: John Joseph Woollett, Wellington (NZ); Peter John Hume, Wellington (NZ)

(73) Assignee: Nexus Developments Limited, Grenada North, Wellington (NZ)

( * ) Notice: Subject to any disclaimer, the term of this patent is extended or adjusted under 35 U.S.C. 154(b) by 200 days.

(21) Appl. No.: 14/365,286

(22) PCT Filed: Dec. 13, 2012

(86) PCT No.: PCT/NZ2012/000237

§ 371 (c)(1),
(2) Date: Jun. 13, 2014

(87) PCT Pub. No.: WO2013/089566

PCT Pub. Date: Jun. 20, 2013

(65) Prior Publication Data

US 2014/0373771 A1 Dec. 25, 2014

Related U.S. Application Data

(60) Provisional application No. 61/570,216, filed on Dec. 13, 2011.

(51) Int. Cl.
*G09F 17/00* (2006.01)

(52) U.S. Cl.
CPC ..... *G09F 17/00* (2013.01); *G09F 2017/005* (2013.01); *G09F 2017/0025* (2013.01); *Y10T 29/49716* (2015.01)

(58) Field of Classification Search
CPC ..... G09F 17/00; G09F 17/0091; G09F 2017/0025; G09F 2017/0041
USPC ..... 116/173, 174, 175; 248/511, 514, 517, 248/528, 529, 538, 539; 40/601, 606.12, 40/607.09, 611.01, 611.06, 611.07, 40/611.08, 611.09, 611.1, 611.12, 611.13
See application file for complete search history.

(56) References Cited

U.S. PATENT DOCUMENTS 4,720,137 A 1/1988 Higgins
4,886,084 A 12/1989 Lawrence et al.

(Continued)

FOREIGN PATENT DOCUMENTS

DE 3010029 A1 9/1981
DE 4141688 C2 9/1999
JP 2007133337 A 5/2007

(Continued)

OTHER PUBLICATIONS

International Search Report and International Preliminary Report on Patenability issued in International Application No. PCT/NZ2012/000237 on Jun. 17, 2014, 14 pages.

(Continued)

*Primary Examiner* — R. A. Smith
(74) *Attorney, Agent, or Firm* — Rothwell, Figg, Ernst & Manbeck, P.C.

(57) ABSTRACT

An apparatus (1) for deploying and supporting a flexible object (7). The apparatus comprises an elongate support (3) comprising a longitudinal first guide (4), an elongate flexible member (5) longitudinally slidable relative to the first guide (4), a first connector (9), connected to the flexible elongate member (5) and adapted to be attached to the flexible object (7), a longitudinal second guide 6, and at least one sliding connector (9, 11, 13); (106, 111, 113; 209, 211, 213), longitudinally slidable relative to the second guide (6) and adapted to be attached to the flexible object (7). The flexible elongate member (5) is adapted to be pushed along the first guide (4) via an externally applied longitudinal force, transferred as a compressive internal force along the flexible member (5), to move the flexible object (7) from a first position to a deployed position.

28 Claims, 8 Drawing Sheets

(56) References Cited

U.S. PATENT DOCUMENTS

| | | | | |
|---|---|---|---|---|
| 5,090,145 | A * | 2/1992 | Chiang | A47G 1/065 40/605 |
| 5,396,680 | A | 3/1995 | Belanger | |
| 5,408,770 | A | 4/1995 | Suzuki | |
| 5,409,191 | A | 4/1995 | Wenmaekers | |
| 5,862,773 | A * | 1/1999 | Kaufman | G09F 17/00 116/173 |
| 5,862,925 | A | 1/1999 | Grzywinski | |
| 6,094,801 | A | 8/2000 | Howe | |
| 6,484,992 | B1 | 11/2002 | Svensson et al. | |
| 6,530,165 | B2 | 3/2003 | Griesemer et al. | |
| 8,109,225 | B2 * | 2/2012 | McCudden | E04H 12/32 116/173 |
| 2009/0320740 | A1 | 12/2009 | Hume et al. | |

FOREIGN PATENT DOCUMENTS

| | | | | |
|---|---|---|---|---|
| JP | 2009139864 | A | 6/2009 | |
| WO | WO 2010102354 | A2 * | 9/2010 | G09F 15/00 |

OTHER PUBLICATIONS

Supplementary European Search Report issued in EP 12 85 7578 on Jul. 13, 2015, 5 pages.

* cited by examiner

METHOD AND APPARATUS FOR DEPLOYING AND SUPPORTING A FLEXIBLE OBJECT

CROSS REFERENCE TO RELATED APPLICATIONS

This application is a 35 U.S.C. §371 National Phase Entry Application from PCT/NZ2012/000237, filed Dec. 13, 2012, and designating the United States, which claims the benefit of U.S. Provisional Patent Application No. 61/570,216 filed Dec. 13, 2011, which are incorporated herein by reference in their entireties.

FIELD OF THE INVENTION

This invention relates to a method and apparatus for deploying and supporting a flexible object. In particular this invention relates to flying or hanging of flexible objects such as flags, banners, visual display or advertising material, festive lighting, or decorations. More particularly, the invention relates to a method and apparatus for deploying a flexible object such as a flag by moving or raising the object from a first to a second location, and supporting the object at the second location.

Flags, banners, pennants, burgees, colours, ensigns, jacks and standards, and the like, are to be understood as included by either one of the terms 'flag' or 'banner', and the corresponding plural forms, when used in this specification which uses these terms generically. The term 'flexible object' as used herein is to be understood to mean any object where the object as a whole is substantially flexible, and includes objects such as strings of lights that have rigid portions (lights) connected by flexible portions (wires).

BACKGROUND

Flags have been known for many millennia, and are typically flown from an upstanding or outstanding staff, or flagpole. In general, flags have a 'hoist' edge at which the flag is supported. Flags can be flown with the hoist edge substantially vertical, such as when the flag is flown from a vertical flagpole, or inclined or horizontal. In the latter configurations, the suspended flag can remain unfurled, even in the absence of wind or other air movement.

In one common arrangement, flags are hoisted up a flagpole by attachment of the upper end of the hoist edge of the flag to a clip on one bight of a halyard which has been previously configured to run over a sheave in an enclosed pulley at a truck at or near the head of the flagpole. The flag is then raised by pulling down on the other bight of the halyard.

The halyard system is vulnerable to misalignment or jamming of the halyard at the sheave. It is generally only suitable for use in straight, upright flagpoles, not in curved or irregularly shaped flagpoles. Furthermore, if one end of the halyard is inadvertently released, it can rise and the clip can lodge at the masthead pulley or, and particularly if no clip is used, one bight of the halyard may rise and pass over the sheave. Before another flag can be raised up the pole, the halyard clip must be retrieved from the top of the pole or the halyard re-threaded over the masthead sheave. This usually requires the use of a ladder or cherry-picker or the like to gain access to the elevated sheave.

Furthermore, the noise of a halyard, oscillated by wind to strike repetitively against the flagpole, can be annoying.

In other common arrangements, flags or banners are often deployed without halyards or sheaves, being fixed directly to attachment points on flagpoles, walls, or other constructions. This is the most common method for attaching curved or irregularly shaped flags or banners to curved supports.

Banners may also be provided with large hems or sleeves that are open at at least one end, and that can be slipped over the end of an upright or inclined or horizontally cantilevered staff, banner bracket arm, or flagpole. In these, and other, arrangements, the flags and banners are usually flown from elevated positions to improve their visibility and impact. The fitting of a flag to any elevated support often requires the use of a ladder, cherry-picker or the like to provide safe access to the elevated position. For example, hemmed banners flown in public spaces are often deployed over flagpoles cantilevered from streetlight standards. Not only is a ladder or cherry-picker often required, but often traffic or safety control measures are mandated by authorities when the flags are to be installed and flown over roadways or other public spaces.

It can therefore be time consuming and expensive to replace numbers of flags or banners, such as when they have become worn or outdated.

One existing system for deploying a flag or banner from ground level comprises having the flag or banner connected along a hoist edge of the flag or banner to a push-rod that is, in turn, slidable relative to a preferably straight support member. To use that system to mount a banner or flag on a curved support, the banner or flag must be elastic to prevent jamming of the push-rod in the support or to prevent the banner or flag from tearing during deployment. Flags or banners made from elastic material are generally more expensive, more difficult to procure and print, and less durable than those made from traditional inelastic materials. Durability is highly desirable for flags or banners that are to be hung outdoors as they will be subject to various weather conditions.

It is an object of at least preferred embodiments of the present invention to provide an apparatus or method of flying a flag or other flexible object that helps mitigate against at least some of the shortcomings of the prior art, or at least to provide the public with a useful choice.

SUMMARY OF THE INVENTION

A first aspect of the present invention provides an apparatus for deploying and supporting a flexible object. The apparatus comprises: an elongate support comprising a longitudinal first guide, an elongate flexible member longitudinally slidable relative to the first guide, a first connector, connected to the flexible elongate member and adapted to be attached to the flexible object, a longitudinal second guide, and at least one sliding connector longitudinally slidable relative to the second guide and adapted to be attached to the flexible object. The flexible elongate member is adapted to be pushed along the first guide via an externally applied longitudinal force, transferred as a compressive internal force along the flexible member, to move the flexible object from a first position to a deployed position.

The deployed position may be elevated relative to the first position.

The flexible member preferably comprises the longitudinal second guide, and preferably at least a major part of the flexible member is resilient. The flexible member may be a rod, tube, band, strip, or other suitable elongate member.

In an embodiment, the apparatus comprises plurality of sliding connectors. One of the sliding connector(s) may comprise a trailing sliding connector having an engagement feature and the support member may comprise a latch or stop configured to engage the engagement feature as the flexible object is moved to the deployed position. The first connector may comprise a leading connector that is fixed to the flexible member. Preferably there are a plurality of sliding connectors between the first connector and the trailing connector.

The support may comprise a curved portion and may be substantially rigid. Preferably the support comprises a first portion and a second portion and the angle between the first support portion and the second support portion is in the range of 80 to 150 degrees. In one embodiment, the angle between the first support portion and the second support portion is in the range of about 90 to about 120 degrees. In one embodiment, the angle between the first support portion and the second support portion is about 90 degrees. In an alternative embodiment, the angle between the first support portion and the second support portion is about 130 degrees.

The support may comprise a stop to limit sliding of the flexible member along the first guide, such that an end of the flexible member abuts the stop when the flexible object is in the deployed position. The support may be configured to be attached to a fixed construction or may itself be a fixed construction.

In an embodiment, the first guide comprises a track on the support. The first guide may comprise an elongate passage in the support having a longitudinal slot extending substantially along the length of the passage for receiving the flexible member.

In an embodiment, the second guide comprises a longitudinal track extending along at least part of the length of the flexible member. Alternatively, the support may comprise the second guide. In another embodiment, the flexible member may comprise the second guide and the sliding connector(s) define a channel for receiving the flexible member.

The flexible object may be a flag or banner.

A second aspect of the present invention provides a flexible object for deploying and supporting on the apparatus according to the first aspect. The flexible object has a hoist edge with the first connector connected to a leading portion of the hoist edge, and the sliding connector(s) connected to a trailing portion of the hoist edge. At least a portion of the hoist edge is curved.

In one embodiment, the first connector is connected to a leading end of the hoist edge. The sliding connectors are preferably spaced apart. The flexible object may comprise a trailing connector with an engagement feature configured to engage with a catch or stop on the support. The trailing connector may be connected to a trailing end of the hoist edge.

Preferably the hoist edge comprises a first edge portion and a second edge portion that, in a non-flexed configuration, is oriented in the range of 80 to 150 degrees to the first edge portion. In one embodiment, the second hoist edge portion is oriented in the range of about 90 to about 130 degrees to the first edge portion when the flexible object is in a non-flexed configuration. In one embodiment, the second hoist edge portion is at about 90 degrees to the first edge portion when the flexible object is in a non-flexed configuration. In an alternative embodiment, the second hoist edge portion is at about 130 degrees to the first edge portion when the flexible object is in a non-flexed configuration.

The flexible object may be a flag or banner.

A third aspect of the present invention provides a method of deploying and supporting a flexible object. The method comprises: providing an elongate support having a first guide, attaching a first connector to a leading portion of the flexible object, attaching at least one sliding connector to a trailing portion of the flexible object, slidably connecting the sliding connector(s) to a guide on the support or the elongate flexible member such that the sliding connector(s) are longitudinally slidable relative to the guide, attaching the first connector to a leading portion of an elongate flexible member, and slidably connecting the flexible member to the first guide of the support, and pushing the flexible member along the support by applying a longitudinal force to a trailing portion of the flexible member, the force being directed towards the leading portion of the flexible member and transferred as a compressive internal force along the flexible object to move the flexible member and thereby the flexible object to a deployed position.

Preferably at least a portion of the support is curved and the flexible member is resilient.

In one embodiment, the flexible member comprises the guide for the sliding connector(s), and as the flexible member is pushed to the deployed position, the sliding connector(s) slide(s) longitudinally relative to the flexible member. In an alternative embodiment, the support comprises the guide for the sliding connector(s), and as the flexible member is pushed to the deployed position, the sliding connector(s) slide(s) longitudinally relative to the support.

The support may comprise a stop or catch and one of the sliding connector(s) may comprise a trailing sliding connector with an engagement feature that is engagable with the stop or catch; the method according to the third aspect comprising the step of engaging the trailing sliding connector with the stop or catch as the flexible member is pushed to the deployed position.

The method may further comprise securing the flexible member relative to the support so that the flexible object is supported in the deployed position.

Preferably the support comprises a first portion and a second portion and the angle between the first support portion and the second support portion is in the range of 80 to 150 degrees. In one embodiment, the angle between the first support portion and the second support portion is in the range of about 90 to about 130 degrees. In one embodiment, the angle between the first support portion and the second support portion is about 90 degrees. In an alternative embodiment, the angle between the first support portion and the second support portion is about 130 degrees. The flexible object may comprise a flag or banner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting. Where specific integers are mentioned herein which have known equivalents in the art to which this invention relates, such known equivalents are deemed to be incorporated herein as if individually set forth.

As used herein the term "(s)" following a noun means the plural and/or singular form of that noun.

The invention consists in the foregoing and also envisages constructions of which the following gives examples only.

BRIEF DESCRIPTION OF THE DRAWINGS

The present invention will now be described by way of example only and with reference to the accompanying drawings in which.

DETAILED DESCRIPTION OF A PREFERRED EMBODIMENT

Referring to the figures, it will be appreciated that the invention may be implemented in various forms and modes. The following description of a preferred embodiment of the invention is given by way of example only.

Figures 1, 2, 3:
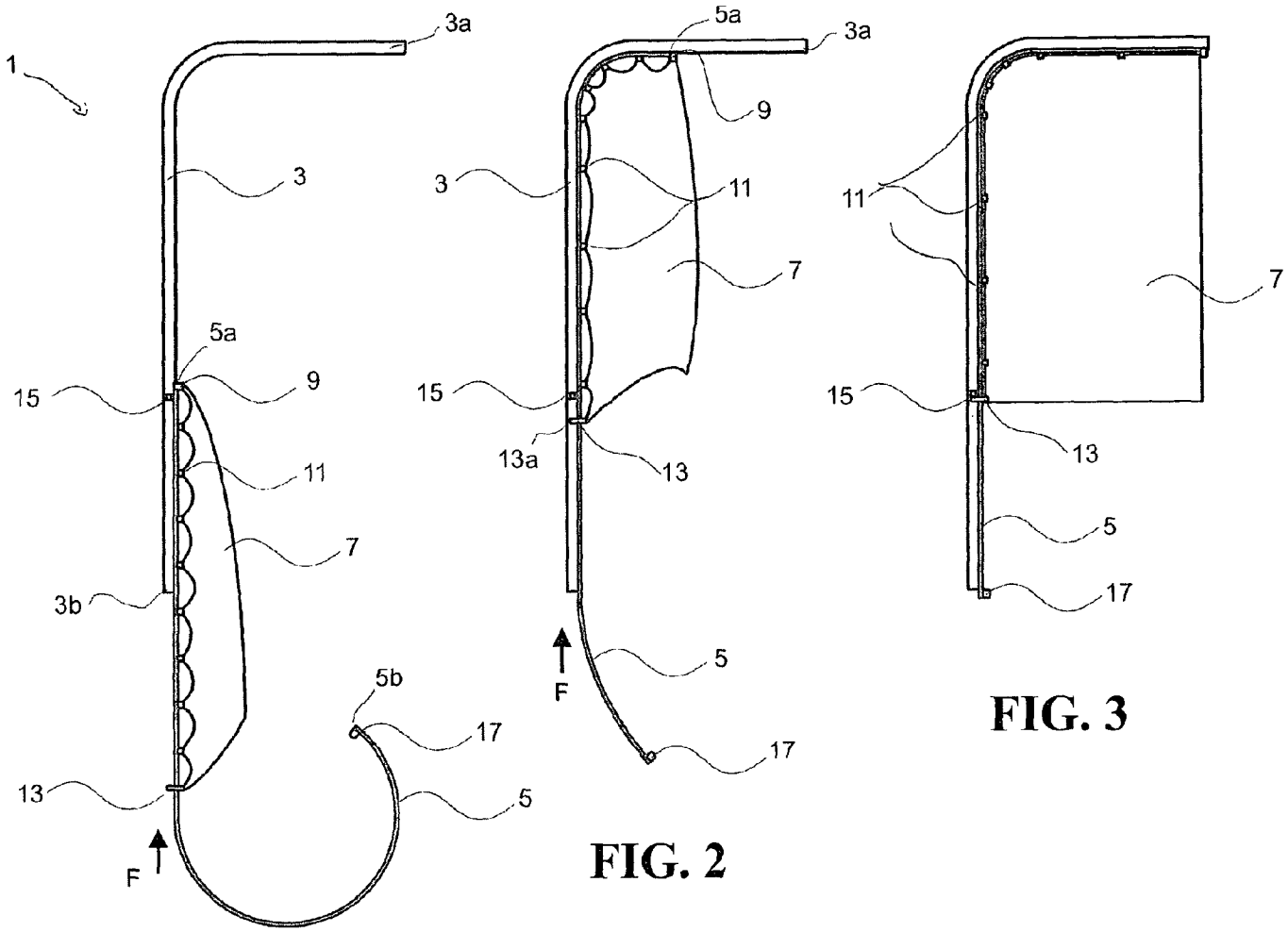
FIG. 1 shows a diagrammatic side view of a flag apparatus according to an embodiment of the present invention, with the flag in a lowered position.
FIG. 2 shows a diagrammatic side view of the apparatus of FIG. 1, with the flag between the lowered position and a deployed position.
FIG. 3 shows a diagrammatic side view of the apparatus of FIGS. 1 and 2, with the flag in a deployed position.
Figures 4, 5, 6:
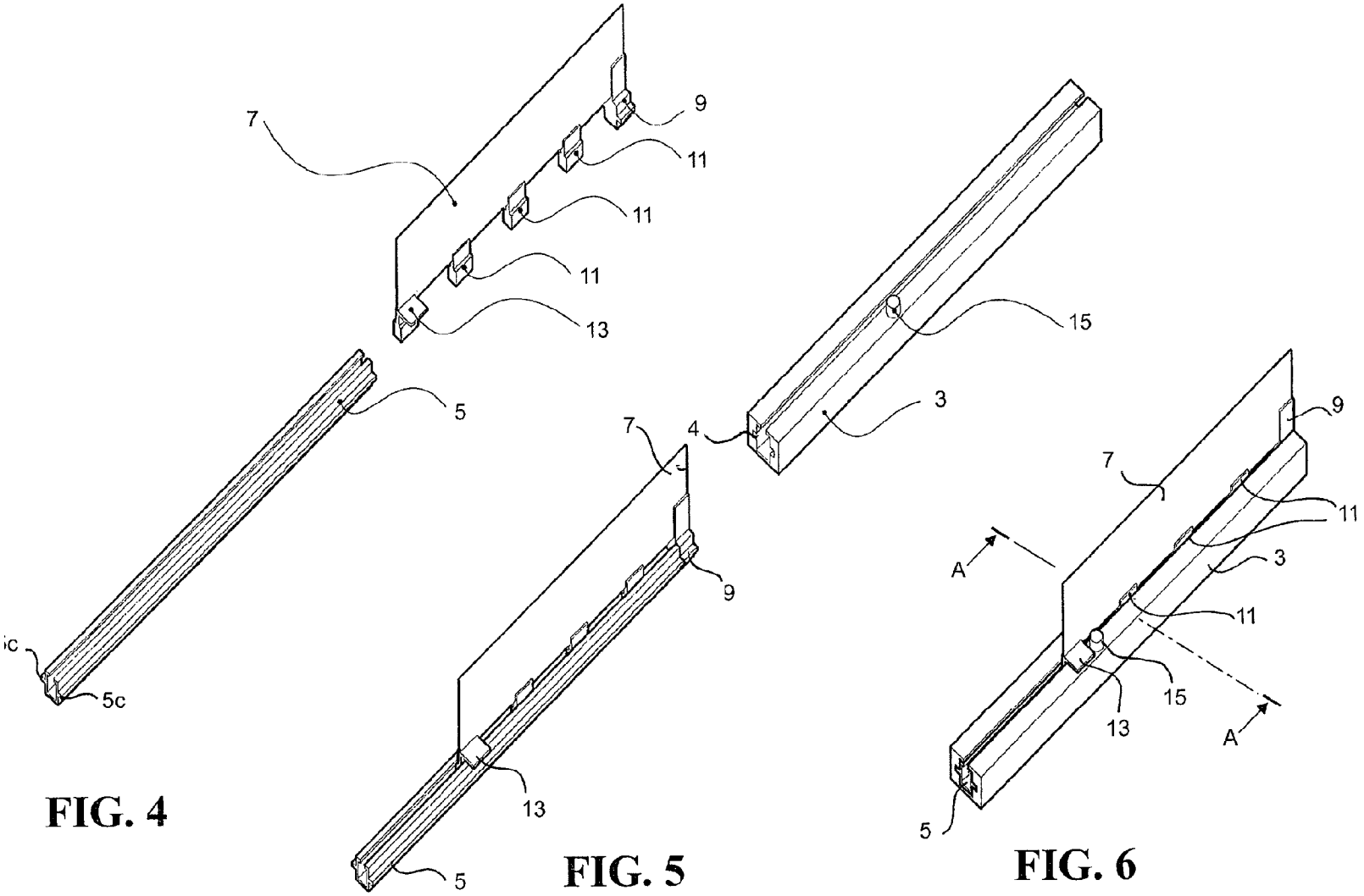
FIG. 4 is an exploded perspective view of a portion of a first embodiment of the invention, showing the connection between the elongate flexible member and the connectors.
FIG. 5 is an exploded perspective view of the embodiment of FIG. 4 showing the connection between the flexible member and the support.
FIG. 6 is a perspective view of the assembled apparatus according to the embodiment of FIGS. 4 and 5.

FIGS. 1 to 16 show an apparatus 1 for moving a flag 7 between a relatively low position to a higher, deployed position. FIG. 1 shows the flag at the lower position whereas FIG. 3 shows the flag raised and flying at the higher deployed position. FIG. 2 shows the flag at an intermediate position between the lowered position and the higher deployed position.

Figure 7:
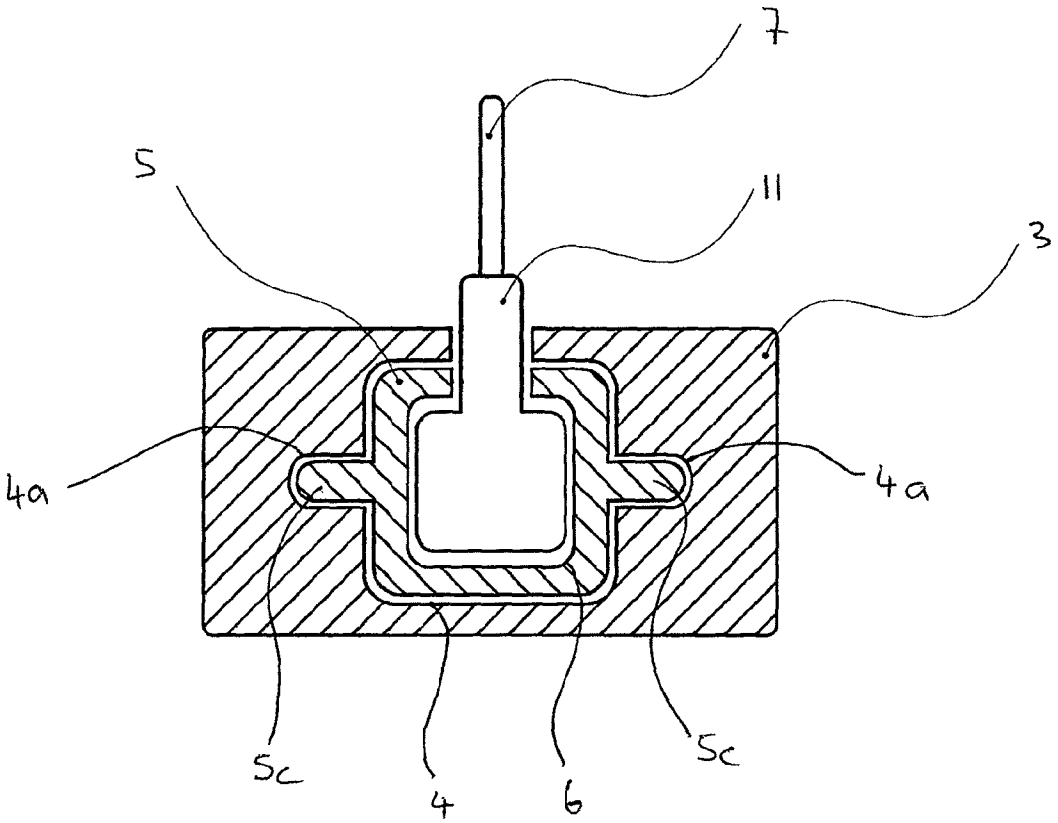
FIG. 7 is a section view taken through section line AA shown in FIG. 6.
Figures 8, 9, 10:
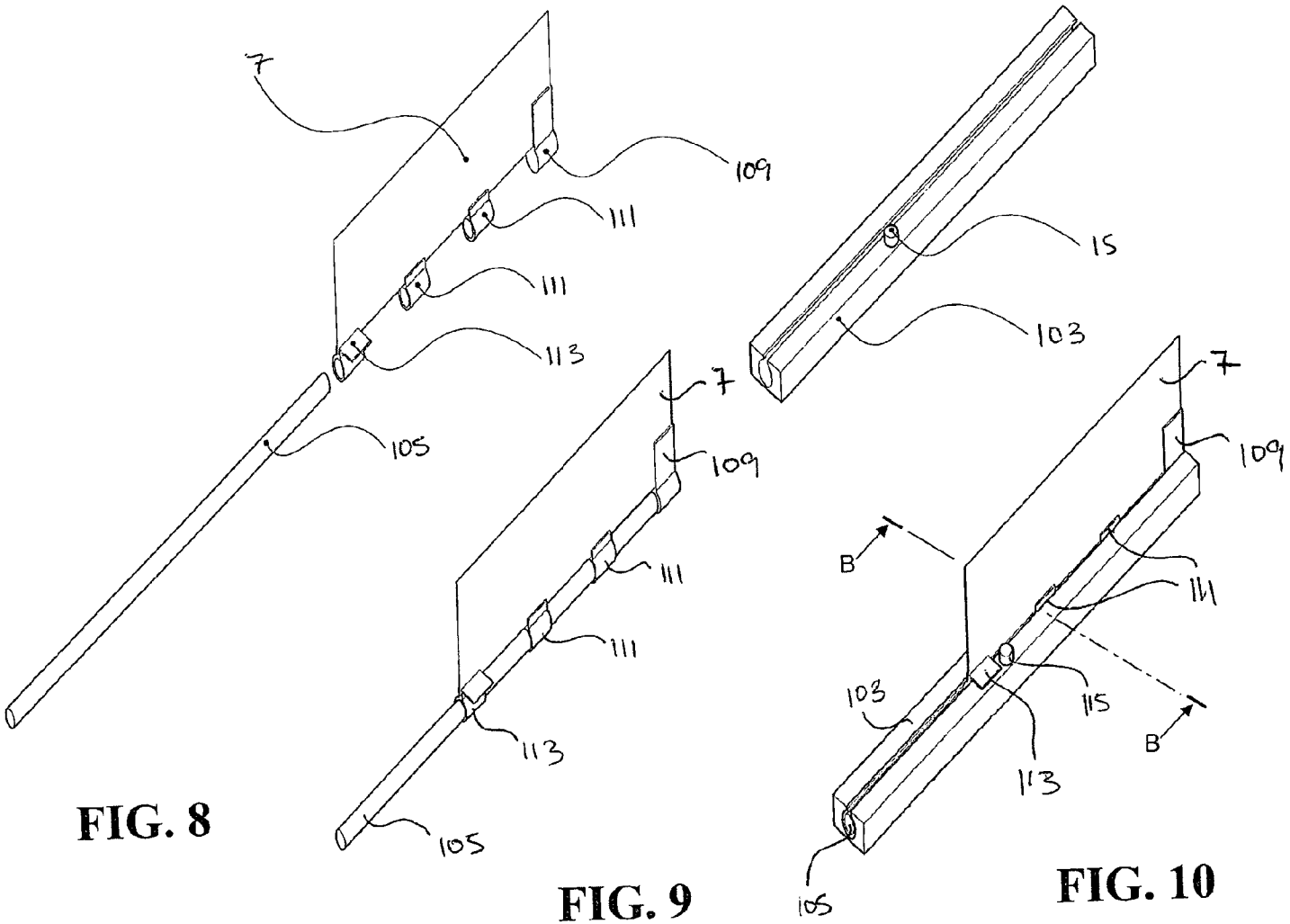
FIG. 8 is an exploded perspective view of a portion of a second embodiment of the invention, showing the connection between the elongate flexible member and the connectors.
FIG. 9 is an exploded perspective view of the embodiment of FIG. 8 showing the connection between the flexible member and the support.
FIG. 10 is a perspective view of the assembled apparatus according to the embodiment of FIGS. 8 and 9.
Figure 11:
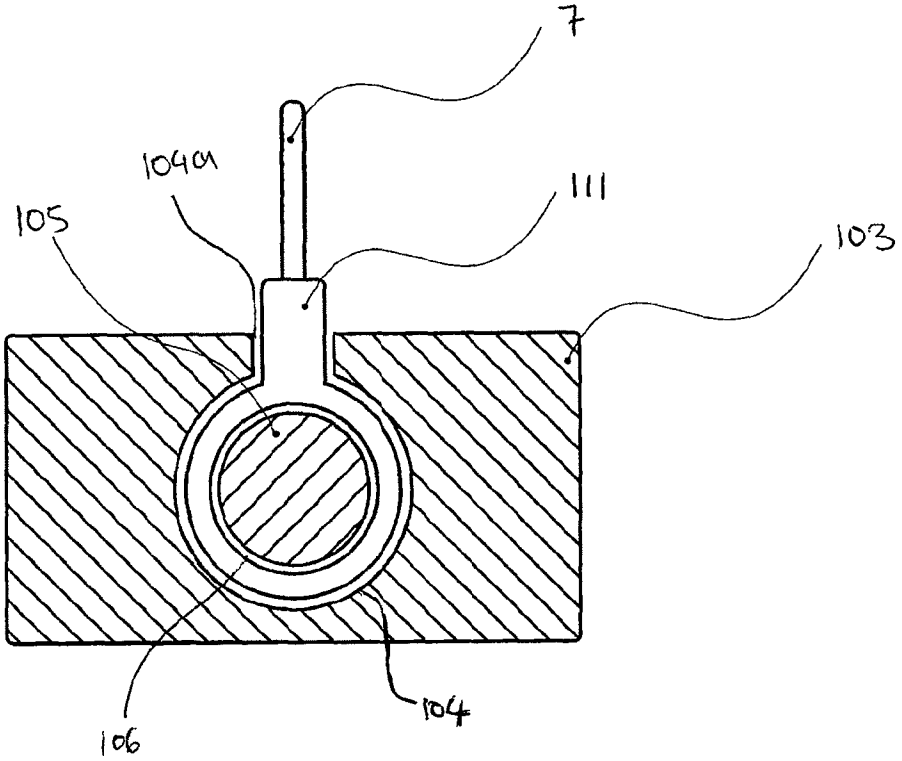
FIG. 11 is a section view taken through section line BB shown in FIG. 10.
Figure 12:
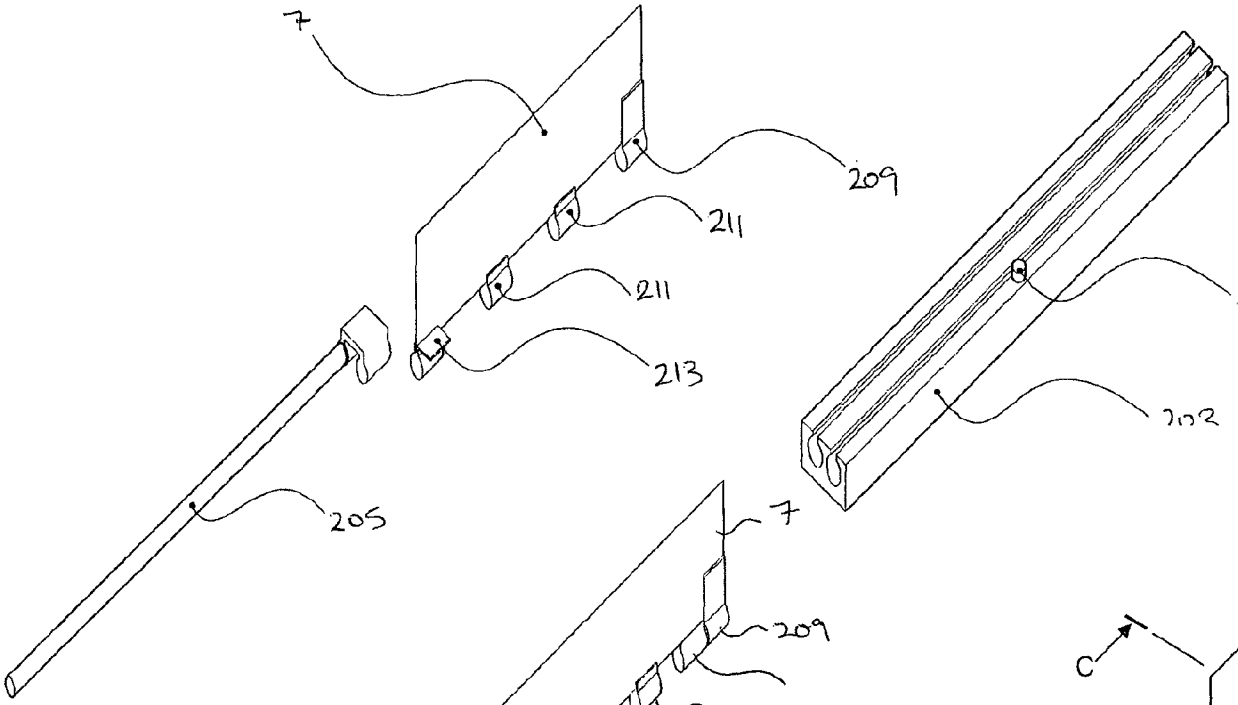
FIG. 12 is an exploded perspective view of a portion of a further embodiment of the invention, showing the connection between the elongate flexible member and the connectors.
Figure 13:
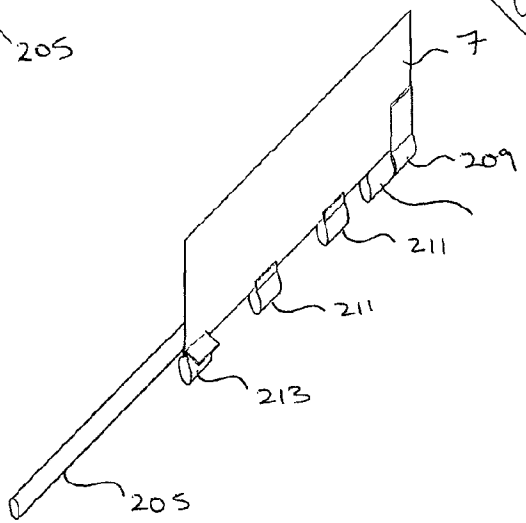
FIG. 13 is an exploded perspective view of the embodiment of FIG. 12 showing the connection between the flexible member and the support.
Figure 14:
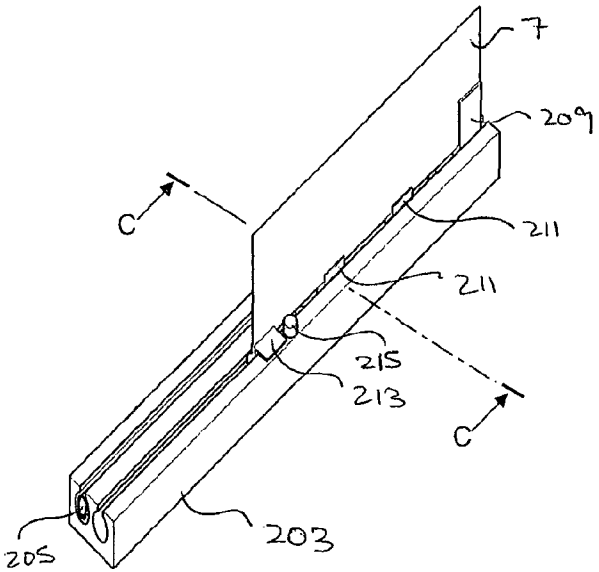
FIG. 14 is a perspective view of the assembled apparatus according to the embodiment of FIGS. 12 and 13.
Figure 15:
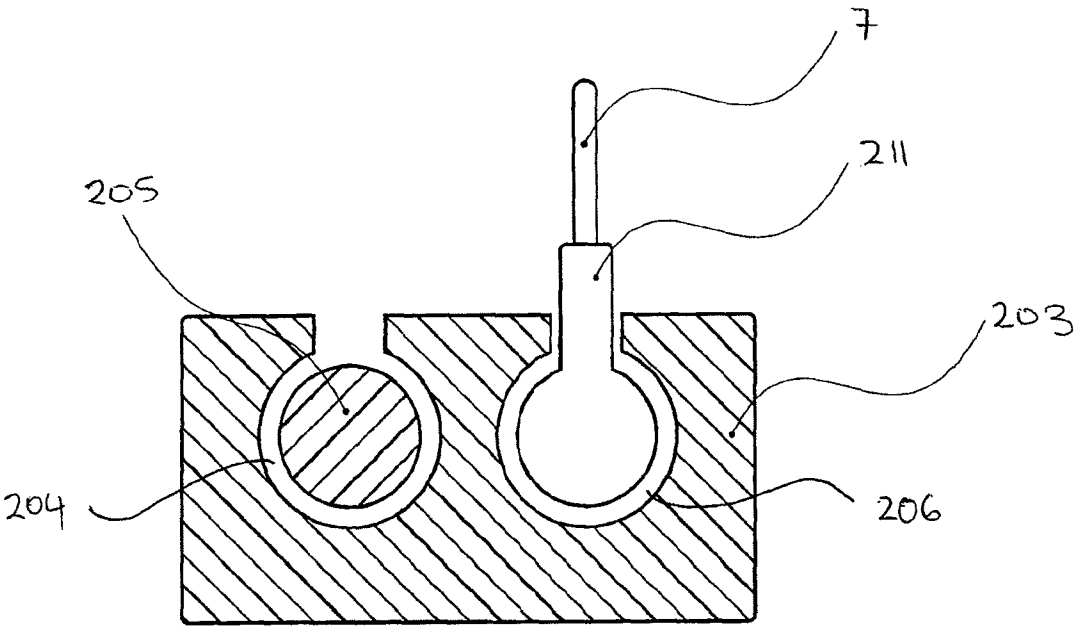
FIG. 15 is a section view taken through section line CC shown in FIG. 14.

The apparatus 1 comprises an elongate support 3 comprising a longitudinal first guide 4 and an elongate flexible member 5 that is slidable relative to the support 3 along the first guide 4. The first guide 4 may be best appreciated from the section view shown in FIG. 7 FIGS. 11 and 15 are cross-sectional views showing the first guides 104, 204 for the alternative embodiments of FIGS. 8-10 and 12-14, respectively.

The flexible member 5 is separable from the support 3 and has a profile or feature for cooperation with the first guide 4. In one embodiment, such as that shown in FIGS. 7-11 and 12-15, the first guide 4 may comprise a track in the support 3, 203 for receiving the flexible member 5, 205 or a portion of the flexible member. In the embodiment of FIG. 7, the track 4 comprises a channel or passage with a front slot and two side slots 4*a* for receiving longitudinal side flanges 5*c* on the flexible member 5. In an alternative embodiment, for example that shown in FIGS. 8 to 11, the track 104 comprises a round passage with a longitudinal front slot 104*a* for receiving a rod-like flexible member having a diameter that is less than the width of the front slot 104*a*. Alternatively, the flexible member 5 may comprise a track or channel for receiving a longitudinal portion, such as a longitudinal flange or protrusion, of the support 3.

A plurality of connectors 9, 11, 13; 109, 111, 113; 209, 211, 213 are attached to a hoist edge of the flag 7 from which the flag is hoisted. Referring to the embodiment of FIGS. 1 to 7, a first leading connector 9 is attached to a leading portion of the hoist edge of the flag 7 and a leading or top portion of the flexible elongate member 5. The leading connector 9 is preferably fixed to the leading end 5*a* of the flexible member 5 and may slide directly along the first guide 4. The leading connector 9 may alternatively be connected to the flexible member 5 at a distance from the leading end 5*a* of the flexible member. The connection between the leading connector 9 and the flexible member 5 is preferably fixed but may be any connection where longitudinal movement of the leading connector 9 is restricted or limited in the direction away from the leading end 5*a* of the flexible member, for example by a stop or fixed connection. The leading portion 5*a* of the flexible member 5 may comprise a feature or opening for removably receiving the leading connector 9.

A plurality of sliding connectors 11, 13 are fixedly attached to and spaced along the hoist edge of the flag 7 on a trailing side of the first leading connector 9. There may be 1, 2 or more sliding connectors 11, 13. The sliding connectors 11, 13 may each be attached directly or indirectly to the flag. The connectors may be permanently fixed to the flag, for example stitched to the flag, or alternatively may be removably attachable to the flag by a hook, clip, or catch, for example.

In the embodiment shown in FIGS. 4 to 7, the flexible member 5 defines a longitudinal second guide 6 in the form of a central track, for slidably receiving the sliding connectors 11, 13 (one of which is shown in FIG. 7). The second guide 6 is configured to be substantially parallel to the first guide 4 when the apparatus is assembled. The flexible member 5 is therefore slidable relative to the support 3 and the sliding connectors 11, 13 are in turn independently slidable relative to the flexible member 5.

In the embodiment shown in FIGS. 8 to 11, the flexible member 105 itself forms the second guide 106, and the sliding connectors 111, 113 each define a channel or passage for receiving the flexible member. The sliding connectors therefore slide directly in the first guide channel 104 of the support 103. The flexible member 105 is slidable relative to the support 103 and the sliding connectors 11, 13 are in turn independently slidable relative to both the flexible member 105 and the support 103.

The second guide 6 may alternatively be provided by the support as shown in FIGS. 12 to 15, for example by way of a track 206 on the support 203 for receiving the sliding connectors 211, 213, or alternatively the second guide may be a longitudinal flange or protrusion, on the support and the sliding connectors may each define a channel, for example, for receiving the second guide.

One sliding connector 13, 113, 213 is a trailing connector attached to the most trailing portion of the hoist edge, preferably at a lower corner of the flag, such that the other sliding connectors are between the first leading connector 9 and the trailing connector 13. The trailing connector 13 comprises an engagement feature 13*a*. In the embodiment shown in the figures, the engagement feature 13*a* is a lip, flange or projection on the connector 13, 113, 213 which extends along the front or side of the support 3, 103, 203. The support 3, 103, 203 has a corresponding catch or stop 15, 115, 215 fixed to the support configured to engage the trailing connector 13 as the flag is raised.

FIG. 1 shows the lower end of the elongate member extending from the lower end of the support 3. To deploy the flag 7 on the apparatus, the flag 7 is first attached to the flexible member 5 via the first leading connector 9. Depending on the embodiment, the flag is also attached to the flexible member 5 or the support 3 by the sliding connectors 11, 13. The sliding connectors are inserted into the guide channel 6 in the flexible member 5 and the leading connector is fixed to the leading end 3*a* of the support, so that the sliding connectors can slide along the guide 6.

The upper end 5*a* of the elongate flexible member 5, is then fed into a lower end 3*b* of the guide channel 4 in the support 3. The lower end of the support 3*b* may be open at a local widening of the guide slot or channel or opening, e.g. by bending outward or cutting away the edges of the channel to provide open access for insertion of the flexible member into the first guide 4.

To raise the flag, the flexible member is pushed along the first guide 4 by applying a longitudinal force to a trailing portion of the flexible member 5. The longitudinal force is externally applied and directed substantially as indicated by the arrow F in FIGS. 1 and 2, towards the leading portion of the flexible member, to slide the flexible member upwards, and with it the attached flag from the leading connector 9.

The force is transferred as an internal compression force along an intermediate portion of the flexible member 5. The flexible member 5 is preferably resilient and substantially incontractible and resists the internal compression force established along its length such that one end of the flexible member 5 can be pushed to move the other end, to which the flag 7 is connected by the leading connector 9.

The flexiblitiy of the flexible member 5 allows it to be curved or coiled, as shown in FIG. 1. This is particularly advantageous in cases where the lower end of the support 3 is too close to a ground or floor level, leaving insufficient room to align a rigid straight elongate member for cooperation with the first guide. As the flexible member 5 is slid up the first guide 4, the coiled lower end 5*b* of the flexible member 5, is gradually uncoiled. The pushing and uncoiling are continued until the flag 7 is in a raised position, such as is shown in FIG. 3.

The support 3 is preferably curved and its curvature may vary along its length. For example, the support shown in the figures has two straight portions at 90° to each other, connected by a curved corner. Alternatively, the straight portions may be at more or less than 90° to each other. For example, in some embodiments, the angle between the straight portions may be in the range of 80° and 130°, preferably about 90° to about 130°. For example, in one alternative embodiment the two straight portions are at about 130° to each other. As a further alternative, a lower portion of the support 3 may be straight and the whole upper portion curved. The flexibility of the elongate flexible member 5 allows it to bend to accommodate the curve or change in curvature, as the flexible member 5 is moved along the curved support 3.

As the flexible member 5 is pushed along the support 3 to raise the flag 7, the sliding connectors 11, 13 can slide relative to each other (and relative to leading connector 9) to accommodate changes in curvature, thereby allowing the flag to gather as necessary. This means the flag, banner or other flexible object isn't placed under tension that could tear the flag, and reduces the likelihood of the flexible member jamming relative to the first guide from tension in the flag being transferred to the flexible member. This makes the present invention suitable for flags, banners or other flexible objects made from relatively inelastic materials.

In one embodiment the flag 7 is flown at a curved portion of the support 3, as shown in FIG. 3, and the hoist edge of the flag is preferably shaped with a curve corresponding to the curve of the support 3.

As the flag 7 is raised to the deployed position, the engagement feature 13*a* on the most trailing connector 13 engages with the stop or catch 15 on the support 3, preventing that connector from being raised any further. Once the trailing connector 13 is engaged, further sliding of the flexible member 5 along the first guide 4 causes the flag or banner to tension, preferably until the flag or banner is taut, as shown in FIG. 3 where the flag 7 is raised and deployed.

In the embodiment shown in the figures, the flexible member 5 is substantially the same length as the elongate support 3. However, the flexible member 5 may alternatively be longer or shorter than the support 3. The upper end 3*a* of the elongate support may comprise a stop 19 which the flexible member abuts when the flag 7 is in the deployed position.

In this way, the flag 7 can be raised from a relatively low level position, such as within easy reach of a person standing safely at ground or floor level, to a relatively high elevated position well above the reach of persons at the lower level. A flag, banner or other flexible object can thus be raised to a relatively high level without using the conventional flag and pole arrangement with a halyard running over a sheave fitted at the higher level, or without needing to lift a person up to the high level, such as on a cherry picker or ladder.

The flag 7 is lowered by reversal of the procedure, by pulling on the flexible member 5 to remove it from the support 3, without requiring anybody to access the upper level. The flag is pulled down by the upper leading connector 9. Typically the flag will gather as it is lowered and the leading connector 9 slides towards the sliding connectors 11. The flexible member 5 is preferably substantially inextensible, allowing the flag to be easily lowered by pulling down on the flexible member 5.

The first guide 4 on the support constrains at least a major portion of the flexible member 5 to follow the general shape of the support 3, thereby preventing the flexible member 5 from bending excessively when under compression, and allowing the flag to be raised. In one advantageous embodiment, the flexibility of the flexible member 5 allows it to readily bend, not only to be moved through any curvature of the constraint, but also to be coiled up into a relatively flat compact form for transportation.

The resilience of the flexible member 5 may make the flexible member alone insufficiently stiff to support the flag 7 at the deployed position. However, the flexible member 5 can support the flag 7 at the deployed position when the flexible member is constrained by the first guide 4 of the elongate support 3.

Figure 16:
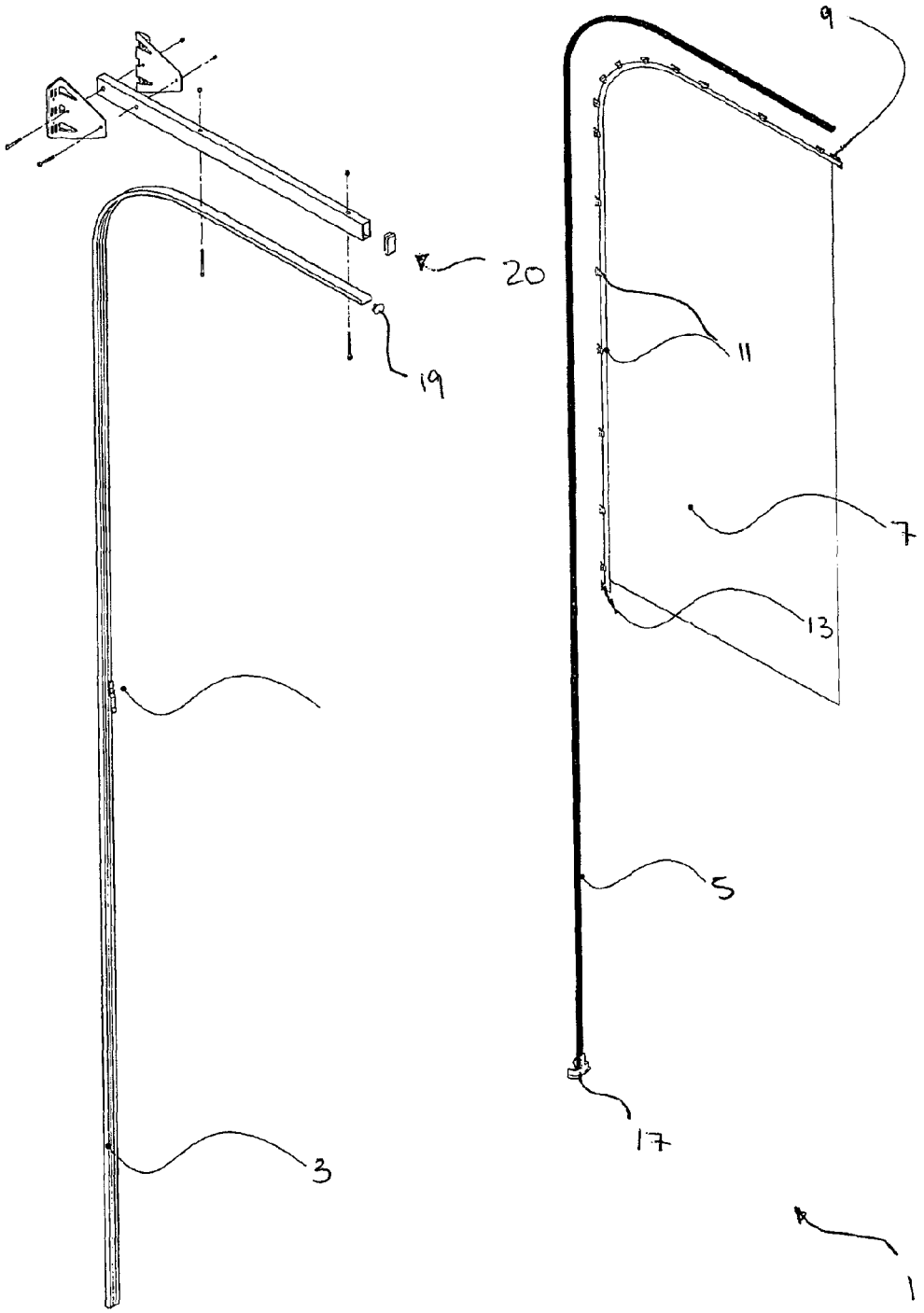
FIG. 16 is an exploded perspective view of the apparatus of FIG. 1, also showing an bracket arrangement for connecting the apparatus to a fixed construction.

The support 3 is preferably rigid and may itself be fixed and free standing or it may be supported by attachment to a fixed construction (not shown in the figures), such as a pole, streetlamp standard, or the exterior or interior wall of a building, for example. The support 3 may comprise flanges, tabs or other features by which it can be attached to a fixed construction by an adhesive or by fasteners such as screws, nails, staples, rivets, or strapping. FIG. 16 shows an example of one possible method of attachment to an upright construction (not shown) using a bracket arrangement 20.

Two or more flags may be attached to a common elongate flexible member 5 supported as described above.

In a preferable arrangement, the elongate flexible member 5 is made as one length of a flexible plastics material. PVC has been found to be particularly suitable. Other suitable materials include metals, and resins or plastics, with or without reinforcement by fibres such as glass or carbon for example. The flexible member 5 may be a tube or rod and may be extruded or pultruded from plastics or resin materials, optionally reinforced with fibres, such as glass or carbon fibres.

When the flag, flags or other flexible object(s) have been raised and are at the elevated location ready for flying, the lower end of the flexible member 5 can be fixed or secured to the constraint to hold the flexible member and the flag 7 or other flexible object(s) in that position. The fixing can be by any suitable means, for example by a pin inserted through the tubular constraint at a point below, or through, the lower end portion of the flexible member.

In a preferred embodiment the trailing end comprises a locking device 17 for securing the flexible member 5 to the support 3. In one embodiment the locking device comprises a resilient latch for engaging a detent on the support. To disengage the flexible member from the support a tool such as a screwdriver may be used to pry the latch out of the detent. Alternatively the locking device 17 may comprise a lock or a tamper resistant screw pin to reduce the likelihood of unauthorised interference with, or removal of, the flag.

The foregoing describes the invention with reference to a preferred embodiment. Alterations and modifications as will be obvious to those skilled in the art are intended to be incorporated within the scope of the invention as defined in the accompanying claims. For example, although the preferred embodiments are generally described as for raising a flag from a low level to a higher level, the invention has equal applicability to the movement of a flag from a first location to a second location that is remote from the first, such as below, or horizontally spaced from, the first location.

The invention can be applied to flags and banners or other substantially flexible objects other than flags or banners. For example, the invention can be applied to flags and banners made from plastics, such as polyvinyl chloride (PVC), to flags, banners and posters made from paper or paper-based materials, or to festive decorations or strings of lights, or projection screens.

Preferred embodiments of the invention have been described by way of example only and modifications may be made thereto without departing from the scope of the invention.

The invention is particularly advantageous where there is an ongoing need for objects to be raised to, supported at, and lowered from, elevated positions on curved supports and that would otherwise require ladders, scaffolding, cherry-pickers, or the like. Once installed, the invention allows for the successive deployment of objects at elevated positions by personnel remaining at floor or ground level.

The term 'comprising' as used in this specification and claims means 'consisting at least in part of', that is to say when interpreting statements in this specification and claims which include that term, the features, prefaced by that term in each statement, all need to be present but other features can also be present.

The invention claimed is:

1. An apparatus for deploying and supporting a flexible object, the apparatus comprising:

an elongate support comprising a longitudinal first guide;

an elongate flexible member longitudinally slidable relative to the first guide;

a first connector, connected to the flexible elongate member and adapted to be attached to the flexible object;

a longitudinal second guide; and at least one sliding connector longitudinally slidable relative to the second guide and adapted to be attached to the flexible object;

wherein the flexible elongate member is adapted to be pushed along the first guide via an externally applied longitudinal force, transferred as a compressive internal force along the flexible member, to move the flexible object from a first position to a deployed position.

2. An apparatus as claimed in claim 1, wherein at least a major part of the flexible member is resilient.

3. An apparatus as claimed in claim 1, wherein the flexible member comprises the longitudinal second guide.

4. An apparatus as claimed in claim 1, wherein the support comprises a curved portion.

5. An apparatus as claimed in claim 4, wherein the support comprises a first portion and a second portion, and wherein the angle between the first support portion and the second support portion is in the range of 80 to 150 degrees.

6. An apparatus as claimed in claim 1, wherein one of the sliding connector(s) comprises a trailing sliding connector having an engagement feature and the support member comprises a latch or stop configured to engage the engagement feature as the flexible object is moved to the deployed position.

7. An apparatus as claimed in claim 6, comprising a plurality of sliding connectors between the first connector and the trailing connector.

8. An apparatus as claimed in claim 1, wherein the first guide comprises a track on the support.

9. An apparatus as claimed in claim 1, wherein the first guide comprises an elongate passage in the support having a longitudinal slot extending substantially along the length of the passage, for receiving the flexible member.

10. An apparatus as claimed in claim 1, wherein the second guide comprises a longitudinal track extending along at least part of the length of the flexible member.

11. An apparatus as claimed in claim 1, wherein the support comprises the second guide.

12. An apparatus as claimed in claim 1, wherein the flexible member comprises the second guide and the sliding connector(s) define a channel for receiving the flexible member.

13. An apparatus as claimed in claim 1, wherein the support comprises a stop to limit sliding of the flexible member along the first guide, the apparatus configured such that an end of the flexible member abuts the stop when the flexible object is in the deployed position.

14. An apparatus as claimed in claim 1, wherein the first connector comprises a leading connector that is fixed to the flexible member.

15. An apparatus as claimed in claim 1, wherein the flexible object comprises a flag or banner.

16. A flexible object for deploying and supporting on the apparatus of claim 1, the flexible object having a hoist edge with the first connector connected to a leading portion of the hoist edge and the sliding connector(s) connected to a trailing portion of the hoist edge, wherein at least a portion of the hoist edge is curved.

17. A flexible object as claimed in claim 16, wherein the first connector is connected to a leading end of the hoist edge.

18. A flexible object as claimed in claim 16, comprising a trailing connector, wherein the trailing connector comprises an engagement feature configured to engage with a catch or stop on the support.

19. A flexible object as claimed in claim 16, wherein the trailing connector is connected to a trailing end of the hoist edge.

20. A flexible object as claimed in claim 16, wherein the sliding connectors are spaced apart.

21. A flexible object as claimed in claim 16, wherein the flexible object comprises a flag or banner.

22. A flexible object as claimed in claim 16, wherein the hoist edge comprises a first edge portion and a second edge portion that, in a non-flexed configuration, is in the range of 80 to 150 degrees to the first edge portion.

23. A method of deploying and supporting a flexible object, the method comprising:

providing an elongate support having a curved portion and a first guide;

attaching a first connector to a leading portion of the flexible object;

attaching at least one sliding connector to a trailing portion of the flexible object;

slidably connecting the sliding connector(s) to the first guide on the support of an elongate flexible member such that the sliding connector(s) are longitudinally slidable relative to the first guide;

attaching the first connector to a leading portion of the elongate flexible member; and slidably connecting the flexible member to the first guide of the support; and pushing the flexible member along the support by applying a longitudinal force to a trailing portion of the flexible member, the force being directed towards the leading portion of the flexible member and transferred as a compressive internal force along the flexible object to move the flexible member and thereby the flexible object to a deployed position.

24. A method as claimed in claim 23, wherein the flexible member comprises the first guide for the sliding connector(s), and as the flexible member is pushed to the deployed position, the sliding connector(s) slide(s) longitudinally relative to the flexible member.

25. A method as claimed in claim 23, wherein the support comprises the first guide for the sliding connector(s), and as the flexible member is pushed to the deployed position, the sliding connector(s) slide(s) longitudinally relative to the support.

26. A method as claimed in claim 23, wherein the support comprises a stop or catch and one of the sliding connector(s) comprises a trailing sliding connector comprising an engagement feature that is engagable with the stop or catch, the method comprising the step of engaging the trailing sliding connector with the stop or catch as the flexible member is pushed to the deployed position.

27. A method as claimed in claim 23, the method further comprising securing the flexible member relative to the support so that the flexible object is supported in the deployed position.

28. A method as claimed in claim 23, wherein the flexible object comprises a flag or banner.

* * * * *